US006230800B1

(12) United States Patent
Bryant

(10) Patent No.: US 6,230,800 B1
(45) Date of Patent: May 15, 2001

(54) METHODS AND APPARATUS FOR LONG TERM MONITORING OF A HYDROCARBON RESERVOIR

(75) Inventor: Ian Bryant, Ridgefield, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 09/359,780

(22) Filed: Jul. 23, 1999

(51) Int. Cl.[7] ..... E21B 47/00

(52) U.S. Cl. ..... 166/250.01; 166/65.1; 166/254.2

(58) Field of Search ..... 166/250.01, 66, 166/65.1, 64, 113, 254.2, 254.1

(56) References Cited

U.S. PATENT DOCUMENTS

| | | | |
|---|---|---|---|
| 4,475,491 | 10/1984 | Griinwald et al. | 123/146.5 |
| 4,775,009 | 10/1988 | Wittrisch et al. | 166/250 |
| 4,986,350 | 1/1991 | Czernichow | 166/65.1 |
| 5,206,840 | 4/1993 | Cobbs et al. | 367/178 |
| 5,214,384 | 5/1993 | Sprunt et al. | 324/351 |
| 5,233,304 | 8/1993 | Hubans | 324/323 |
| 5,243,562 | 9/1993 | Laurent et al. | 367/25 |
| 5,265,680 | 11/1993 | Withers et al. | 166/380 |
| 5,303,773 | 4/1994 | Czernichow et al. | 166/66 |
| 5,355,952 | 10/1994 | Meynier | 166/250 |
| 5,363,094 | 11/1994 | Staron et al. | 340/854.6 |
| 5,467,823 | 11/1995 | Babour et al. | 166/250.01 |
| 5,481,502 | 1/1996 | Cretin et al. | 367/77 |
| 5,503,225 | 4/1996 | Withers | 166/250.1 |
| 5,505,259 | 4/1996 | Wittrisch et al. | 166/250.01 |
| 5,524,709 | 6/1996 | Withers | 166/250.1 |
| 5,597,042 | 1/1997 | Tubel et al. | 166/250.01 |
| 5,642,051 | 6/1997 | Babour et al. | 324/357 |
| 5,662,165 | 9/1997 | Tubel et al. | 166/250.01 |
| 5,724,311 | 3/1998 | Laurent et al. | 367/57 |
| 5,767,680 | 6/1998 | Torres-Verdin et al. | 324/355 |
| 5,892,733 | 4/1999 | Havig . | |

FOREIGN PATENT DOCUMENTS

| | | | |
|---|---|---|---|
| 2 276 723 | 10/1994 | (GB) | G01V/1/40 |
| WO 97/37103 | 10/1997 | (WO) . | |
| WO 98/1241 | 3/1998 | (WO) . | |
| WO 98/15850 | 4/1998 | (WO) . | |

OTHER PUBLICATIONS

Cooke Jr., C.E. et al. "Field Measurements of Annular Pressure and Temperature During Primary Cementing". *Journal of Petroleum Technology,* US, AIME, Dallas, Tx. (Aug. 1, 1983) pp. 1429–1438.

*Primary Examiner*—Frank Tsay
(74) *Attorney, Agent, or Firm*—William B. Batzer; David P. Gordon

(57) ABSTRACT

The methods and apparatus of the invention include installing sensors in one or more of the many hole sections which are abandoned before the holes are sealed with cement. According to the invention, a sensor array is attached to the cement delivery device which is used to seal a hole which would otherwise be abandoned. The preferred apparatus for cement delivery is a "coiled tubing". Preferably, the sensor array is passed through the center of the tubing so that it is protected from damage or snagging while being delivered to its deployment position. The coiled tubing may be withdrawn or left in place after the cement is delivered into the hole. When the cement cures, the sensor array is centered in the cement plug which seals the reservoir. According to the invention, the sensor array may be placed in any well which is to be abandoned. Such wells include exploration wells, appraisal wells, delineation wells, collapsed wells, oil wells which develop high levels of gas or water production, and gas wells which develop high levels of water production. In addition, the sensor array may be deployed in an unused portion of a production or injection well. For example, the sensor array may be located in a logging pocket. Similarly, the sensor array may be located in the pilot hole of a horizontal well.

15 Claims, 3 Drawing Sheets

METHODS AND APPARATUS FOR LONG TERM MONITORING OF A HYDROCARBON RESERVOIR

BACKGROUND OF THE INVENTION

1. Field of the Invention

The invention relates to the management of hydrocarbon production. More particularly, the invention relates to methods and apparatus for the long term monitoring of reservoir fluids by locating instruments in wells.

2. State of the Art

In an oil field, numerous holes are drilled into the formation before and after oil production begins. Some holes are discovery, appraisal, and delineation wells to determine the location and boundaries of a petroleum reservoir. Other holes will become injection and production wells. Many of the hole sections which are not used for production (e.g., all except the injection and production wells) are usually sealed with cement. The injection and production wells are, in most parts of the world, each completed by installing a casing in the hole and surrounding the casing with cement. The casing is usually made from metal pipe sections having a diameter close to that of the well hole. The sections are lowered into the well hole and cement is poured into the annulus between the casing and the formation. The casings are then perforated at predetermined depths where it is believed that an oil reservoir is located.

Water may be naturally present in the reservoir acting on the oil to urge it out through the well bore. Often, water (or steam) is injected into the reservoir from an injection bore located near the production bore. As oil is extracted from the well, the water moves through the porous media of the formation closer to the production well. As a result, the oil-water interface changes shape. If the location of the oil-water interface is not monitored during production, it is possible that the well will produce a mixture of oil and water. In some cases, it is possible for the well to produce more water than oil. Similarly, it may be desirable to monitor the oil-gas interface should one exist.

Well logs are a primary source of information used to map the distribution of fluids in hydrocarbon reservoirs. The logs are made from various sensor measurements such as resistivity, pressure, temperature, sonic velocity, etc. It is a common practice in a producing well to interrupt production and re-enter the well with wireline logging tools in order to ascertain changes in the reservoir which occur as a result of production. This practice is undesirable because it interrupts production and it is expensive. In addition, logging tools used inside a production casing can only measure satisfactorily water saturation and can not measure satisfactorily changes in formation pressure, a measure which is very useful in determining the efficiency with which fluids are being extracted from the formation. Furthermore, in a completed sub-sea well, re-entry into the well with logging tools may be either impossible or prohibitively expensive.

U.S. Pat. No. 4,475,591 discloses a method for obtaining pressure measurements in a producing well by permanently mounting pressure sensors in the cement filling between the formation and the casing. Placement of these sensors is often difficult. When the sensors are located in the cement surrounding the casing, there is a danger that the sensors or the cables to the sensors will be damaged during installation. Damage can also occur during casing perforation or side tracking.

U.S. Pat. No. 5,214,384 discloses a method for electronic self-potential logging in a cased observation well which is located between a steam injector well and a production well. A metallic casing complicates the method and the placement of electrodes in a casing or between a casing and the formation is also difficult as mentioned above. Furthermore, this method requires the drilling of an additional well which will not produce any hydrocarbons.

Co-owned U.S. Pat. No. 5,467,823 discloses a method for long term monitoring of a reservoir by locating a pressure gauge in an observation well which traverses the reservoir. The upper portion of the observation well is cased and the remainder is left open. A measuring device is suspended from a cable and lowered into the observation well to the depth of the reservoir. The measuring device includes a pressure gauge mounted in a casing-like tube section and an explosive perforation device. Cement is injected into the observation well to a depth corresponding to the reservoir. After the cement cures, the explosive device is ignited to perforate the cement and put the reservoir in fluid communication with the pressure gauge. While this method has advantages over the previously described methods, the cable is still in danger of damage as the well is being injected with cement, and the sensor package can be damaged during the perforation explosion.

SUMMARY OF THE INVENTION

It is therefore an object of the invention to provide methods and apparatus for long term monitoring of a hydrocarbon reservoir.

It is also an object of the invention to provide methods and apparatus for measuring formation characteristics of a producing reservoir without interrupting production.

It is another object of the invention to provide methods and apparatus for measuring changes in formation characteristics without interrupting production.

It is still another object of the invention to provide methods and apparatus for directly measuring changes in formation pressure.

It is also an object of the invention to provide methods and apparatus for measuring changes in water saturation in a formation without interrupting production.

It is another object of the invention to provide methods and apparatus for measuring changes in formation characteristics without drilling a special observation well.

It is still another object of the invention to provide methods and apparatus for permanently installing sensors in a well.

It is also an object of the invention to provide methods and apparatus for permanently installing sensors in a well with minimal risk of damage to the sensors or to cables coupled to the sensors.

In accord with these objects which will be discussed in detail below, the methods and apparatus of the present invention include installing sensors in one or more of the many holes which are sealed with cement. According to the invention, a sensor array is attached to the cement delivery device which is used to seal a hole section which would otherwise be abandoned. The preferred apparatus for cement delivery is a "coiled tubing". Preferably, the sensor array is passed through the center of the tubing so that it is protected from damage or snagging while being delivered to its deployment position. However, the sensor array may be strapped to the outside of the tubing. The coiled tubing may be withdrawn or left in place after the cement is delivered into the hole. When the cement cures, the sensor array is preferably fixedly centered in the cement plug which seals the reservoir. The sensors in the array may include electrical sensors, pressure gauges, geophones, or other sensors.

According to the invention, the sensor array may be placed in any well which is to be abandoned. Such wells include exploration wells, appraisal wells, delineation wells, collapsed wells, oil wells which develop high levels of gas or water production, and gas wells which develop high levels of water production. In addition, the sensor array may be deployed in an unused portion of a production or injection well. For example, the sensor array may be located in a logging pocket (an extension of a well beyond its required depth which permits logging tools to log the entire depth of the formation). Similarly, the sensor array may be located in the pilot hole from which a horizontal well is drilled.

The invention has many advantages. In cases where the sensor array is deployed in an uncased well, resistivity measurements are not affected by the large steel mass of a casing. In all cases, utilizing the methods of the invention permits the use of a light weight cable since the weight of the array is supported by the cement delivery device. No separate logging run and no additional equipment is needed since the cement delivery device is used to seal the well and deploy the sensor array in a single run. Better zonal isolation of adjacent pressure gauges is achieved because the array is centrally located in the cement plug rather than located in an annulus between the formation and the casing.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
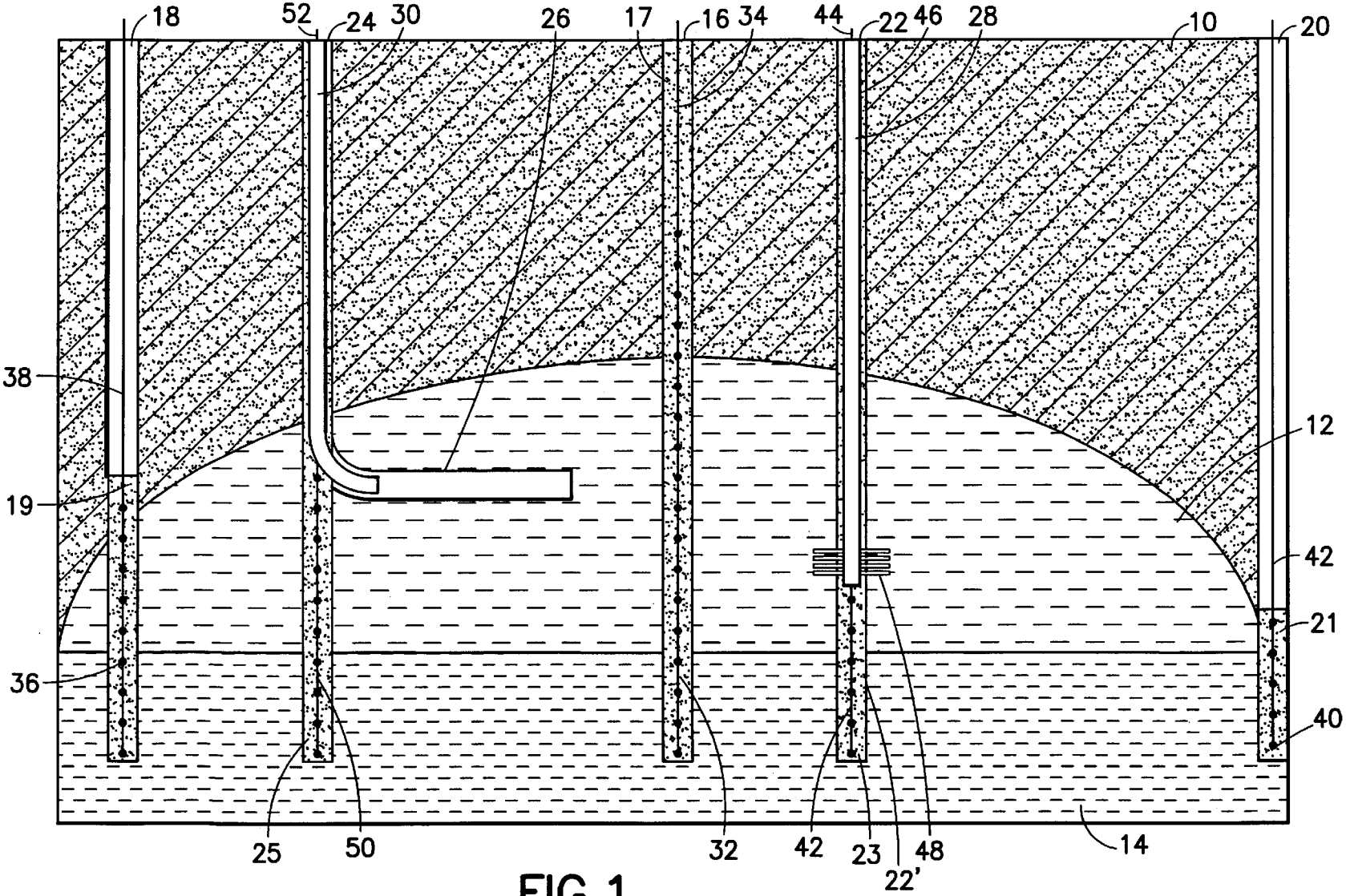
FIG. 1 is a schematic diagram of an oil field having five wells, each well illustrating a sensor deployment according to a different embodiment of the invention.

Referring now to FIG. 1, a typical oil field includes a sealing formation 10, an oil reservoir 12, and a bearing formation 14. During the course of oil field development, several wells are drilled in the field. These may include a discovery well 16, appraisal wells 18 and 20, a development well 22, and a pilot well 24 for a horizontal well 26. Prior to production, the discovery well 16, and the appraisal wells 18 and 20 will be sealed with cement 17, 19, 21 to prevent oil from escaping the reservoir 12 during subsequent production. After the installation of a casing 28, a logging pocket portion 22' of the development well 22 will be sealed with cement 23 to prevent water 14 from entering the oil reservoir 12. Before installation of production tubing 30, the pilot well 24 will be sealed with cement 25.

According to one embodiment of the invention, a sensor array 32, coupled to a cable 34 is deployed in the discovery well 16 prior to filling the well with cement 17. After the cement 17 cures, the sensor array 32 is centrally located in the well 16 and encased in the cement 17.

According to another embodiment, a sensor array 36 coupled to a cable 38 is deployed in the appraisal well 18 before it is sealed with cement 19. Similarly, a sensor array 40 coupled to a cable 42 is deployed in the appraisal well 20 before it is sealed with cement 21. In both of these cases, the sensor arrays are centered in the bore of the well and encased in cement. The cables coupled to the sensor arrays are not necessarily completely encased in cement as it is only necessary to pour enough cement to seal around the oil reservoir 12.

According to still another embodiment, a sensor array 42 coupled to a cable 44 is deployed in the logging pocket 22' of the development well 22 prior to the installation of the casing 46, cement 23, and casing perforations 48. In this embodiment, the sensor array 42 is centered in the logging pocket 22', but the cable 44 is located in the annulus surrounding the casing 46.

According to yet another embodiment, a sensor array 50 coupled to a cable 52 is deployed in the bottom of the pilot well 24 below the horizontal well 26 prior to the installation of the production tubing 30 and the cement 25. In this embodiment, the sensor array 50 is centered in the bottom of the pilot well 24 below the horizontal well 26, but the cable 52 is located in the annulus surrounding the production tubing 30.

As mentioned above, any or all of these embodiments may be deployed in an oil field. The common feature of each embodiment is that each sensor array is placed in a well (or well portion) which is to be abandoned. The sensors in any array may include electrical sensors, pressure gauges, geophones, or other sensors. Any array may contain a variety of sensors.

According to the preferred embodiment of the invention the arrays are delivered to their deployment sites using the same devices which will be used to deliver cement to seal the wells or well portions. Thus, a light weight cable can be used for the sensors since the weight of the array is supported by the cement delivery device. In addition, no separate logging run and no additional equipment is needed since the cement delivery device is used to seal the well and deploy the sensor array in a single run.

Figure 2:
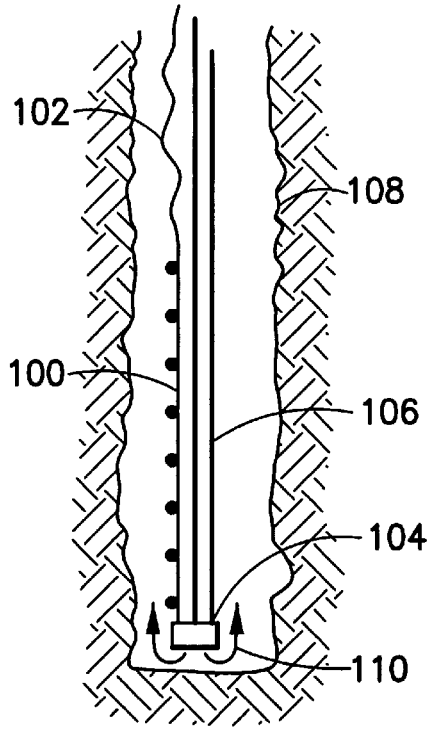
FIG. 2 is a schematic diagram of a cement delivery device with a sensor array releasably coupled thereto prior to delivery of cement.
Figure 3:
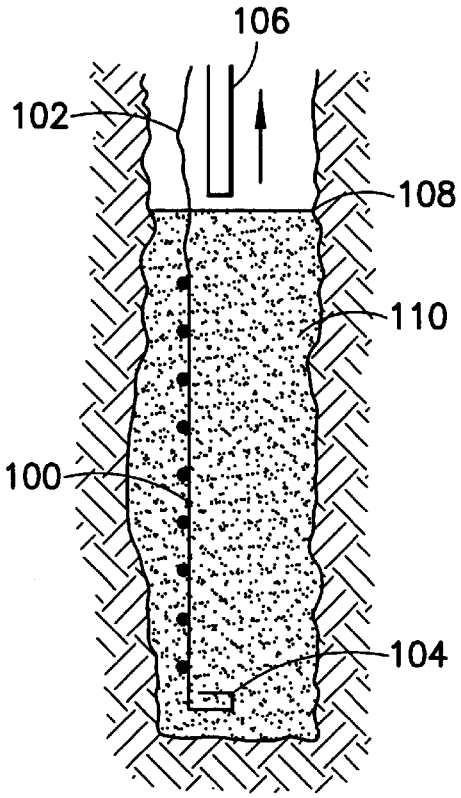
FIG. 3 is a schematic diagram of the sensor array of FIG. 2 after cement delivery and decoupling of the cement delivery device.

Turning now to FIGS. 2 and 3, according to one method of the invention, a sensor array 100, coupled to a cable 102, is attached by a releasable device 104, e.g. a pump-out plug, to the end of a cement delivery tube 106. The tube 106 is run-in to a well bore 108 until the sensor array 100 is at the desired location for deployment. Cement 110 is pumped through the tube 106 and out of the end of the tube causing the device 104 to uncouple from the end of the tube. According to this embodiment, the tube 106 is withdrawn from the borehole 108 in advance of the rising cement 110.

Figure 4:
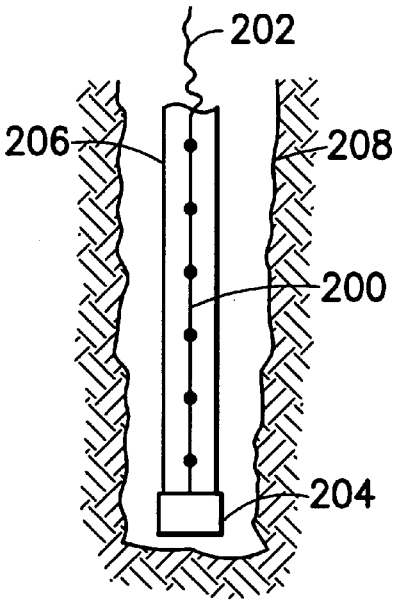
FIG. 4 is a schematic diagram of a "coiled tubing" cement delivery device with a sensor array disposed therein prior to delivery of cement.
Figure 5:
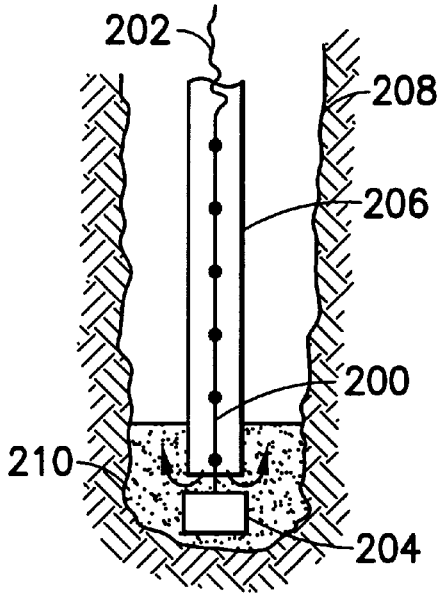
FIG. 5 is a schematic diagram of the sensor array of FIG. 4 at the start of cement delivery.
Figure 6A:
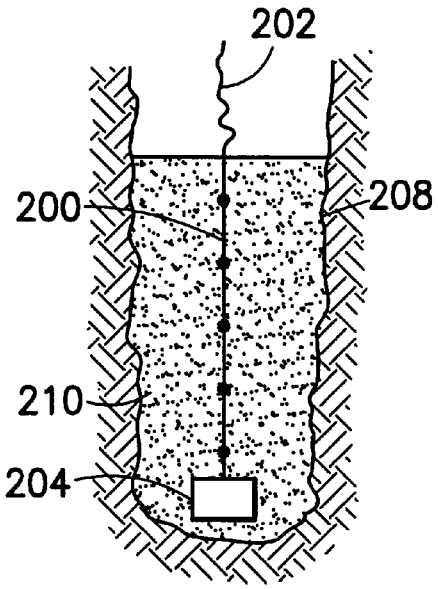
FIG. 6A is a schematic diagram of the sensor array of FIGS. 4 and 5 at the completion of cement delivery according to one method of the invention where the delivery tube is removed from the borehole.
Figure 6B:
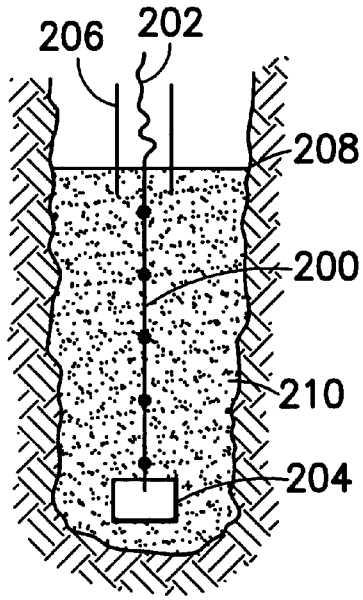
FIG. 6B is a schematic diagram of the sensor array and delivery tube of FIGS. 4 and 5 at the completion of cement delivery according to another method of the invention where the delivery tube remains partially embedded in cement.

Two presently preferred methods of the invention are illustrated in FIGS. 4, 5, 6A, and 6B. As shown in FIGS. 4 and 5, a sensor array 200, coupled to a cable 202, is disposed within "coiled tubing" 206 and connected to the end of the tubing by a releasable device 204. The tube 206 is run-in to a well bore 208 until the sensor array 200 is at the desired location for deployment. Cement 210 is pumped through the tube 206 and out of the end of the tube causing the device 204 to uncouple from the end of the tube. According to a first preferred embodiment illustrated in FIG. 6A, the tube 206 is completely withdrawn from the borehole 208 in advance of the rising cement 210. According to a second preferred embodiment illustrated in FIG. 6B, the tube 206 is partially drawn up the borehole 208 to expose the sensor array 200 but not fully in advance of the rising cement 210. The tube 206 is left in the borehole 208 with a portion of the tube 206 embedded in the cement 210. The embodiment illustrated in FIG. 6B is preferably utilized when the coiled tubing is nearing the end of its useful life. Normally coiled tubing is used several times and then abandoned due to the risk of failure from metal fatigue. According to this embodiment, the otherwise wasted tubing is put to use as a protective conduit surrounding the cable 202 in a location where it will not affect the functioning of the sensors. If, on the other hand, the tubing 206 is still valuable for use in sealing other wells, the method illustrated in FIG. 6A is preferably utilized.

There have been described and illustrated herein several embodiments of methods and apparatus for long term monitoring of a hydrocarbon reservoir. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A method for long term monitoring of a hydrocarbon reservoir, comprising:

a) selecting a well bore which is destined to be sealed with cement;

b) delivering a sensor array coupled to a cable through the well bore to a selected location;

c) filling the well bore with cement so that the sensor array is embedded in cement and the well bore is sealed; and d) using the sensor array to monitor reservoir conditions during the course of hydrocarbon production, wherein said step of delivering includes releasably attaching the sensor array to a cement delivery device and running-in the cement delivery device to the selected location.

2. A method according to claim 1, wherein:

the well bore to be sealed is selected from the group consisting of exploration wells, appraisal wells, delineation wells, collapsed wells, oil wells which have developed high levels of gas or water production, and gas wells which have developed high levels of water production.

3. A method according to claim 1, wherein:

said step of filling includes pumping cement through the cement delivery device and releasing the sensor array from the delivery device.

4. A method according to claim 1, wherein:

said step or releasably attaching includes disposing the sensor array inside the delivery device.

5. A method according to claim 4, wherein:

said step of filling includes pumping cement through the cement delivery device and releasing the sensor array from the delivery device.

6. A method according to claim 5, further comprising:

e) raising the delivery device while filling so that the delivery device is completely removed from the well bore when filling is completed.

7. A method according to claim 5, further comprising:

e) raising the delivery device while filling so that the sensor array is exposed from the delivery device but a portion of the delivery device remains embedded in the cement.

8. A method according to claim 1, wherein:

said step of delivering includes running the cable outside the tubing of a production well.

9. A method according to claim 1, wherein:

said step of delivering includes running the cable outside the casing of a cased well.

10. A system for long term monitoring of a hydrocarbon reservoir, comprising:

a) a sensor array;

b) a cable coupled to said sensor array;

c) deployment means for deploying said sensor array at a location in a well bore which is destined to be sealed with cement; and d) cement delivery means for delivering cement to said location so that said sensor array is embedded in cement and the well bore is sealed, wherein said deployment means includes coupling means for releasably coupling said sensor array to said cement delivery means.

11. A system according to claim 10, wherein:

said coupling means includes means for releasably retaining said sensor array within said cement delivery means.

12. A system according to claim 10, wherein:

said sensor array includes a resistivity sensor.

13. A system according to claim 10, wherein:

said sensor array includes a pressure sensor.

14. A system according to claim 10, wherein:

said sensor array includes a temperature sensor.

15. A system according to claim 11, wherein:

said means for releasably retaining said sensor array within said cement delivery means includes a pump-out plug.

* * * * *